US006250631B1

(12) United States Patent
Hanamoto et al.

(10) Patent No.: US 6,250,631 B1
(45) Date of Patent: Jun. 26, 2001

(54) SHEET HANDLING UNIT

(75) Inventors: Katsuhiko Hanamoto; Nobuhiro Nishioka; Yohichiro Irie, all of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/337,516

(22) Filed: Jun. 22, 1999

(30) Foreign Application Priority Data

Jun. 23, 1998 (JP) ..... 10-176082
Jul. 30, 1998 (JP) ..... 10-215292
Sep. 28, 1998 (JP) ..... 10-273416

(51) Int. Cl.[7] ..... B65H 39/10

(52) U.S. Cl. ..... 271/298; 271/278; 271/279; 271/287; 271/288; 271/289; 271/305

(58) Field of Search ..... 271/3.18, 3.19, 271/4.01, 278, 279, 287, 288, 289, 290, 298, 305

(56) References Cited

U.S. PATENT DOCUMENTS 4,718,657 * 1/1988 Otter et al. ..... 271/184
5,704,609 * 1/1998 Mandel et al. ..... 271/290
6,102,393 * 8/2000 Kida et al. ..... 271/303

* cited by examiner

*Primary Examiner*—Donald P. Walsh
*Assistant Examiner*—Mark J Beauchaine
(74) *Attorney, Agent, or Firm*—Smith, Gambrell & Russell, LLP

(57) ABSTRACT

A sheet handling unit including a processing station having a stapling mechanism for stapling a plurality of sheets; a plurality of mail trays for receiving sheets transported from the processing station; and a bulk tray for receiving sheets transported from the processing station. The processing station is fixedly provided in a sheet handling unit body. The sheets transported from the processing station are delivered switchably to any of the mail trays or to the bulk tray.

11 Claims, 15 Drawing Sheets

Prior Art

SHEET HANDLING UNIT

BACKGROUND OF THE INVENTION

1. Field of the Invention

The present invention relates to a sheet handling unit for placing sheets outputted from an image processing apparatus such as a printer, an electrostatographic copying machine or a facsimile machine in a designated mail tray or a predetermined tray.

2. Description of Related Art

Image processing apparatuses such as printers are often shared by plural information processors such as computers and workstations via networks. In such a case, a single printer, for example, is shared by plural users. The term "user" herein means a single person or a group of persons.

Such a so-called network printer is preferably equipped with a sheet handling unit called a "mailbox unit" which is adapted to place sheets outputted on the basis of each user's print information into the corresponding user-specific mail tray.

With an increase in the processing speed of the image processing apparatuses, there occurs a demand for a sheet handling unit capable of stacking a large volume of sheets. Further, it is often desired that the sheet handling unit additionally has post-processing functions such as a stapling function.

FIG. 15 shows one exemplary sheet handling unit of the prior art which satisfies the aforesaid demands. The sheet handling unit 41 is used in connection with a printer 42, and includes a sheet introduction path 43 for introducing a sheet outputted from the printer 42. The introduction path 43 is branched into an upper and lower branch paths 43*a*, 43*b*. The upper branch path 43*a* guides the sheet to a processing station 45 having a stapling mechanism 44 for stapling a stack of plural sheets. The lower branch path 43*b* is connected to a sheet transportation mechanism 47. The sheet transportation mechanism 47 discharges a sheet selectively to any one of plural mail trays 48 arranged in a vertically spaced and tiered relation adjacent a lower portion of a unit body 52.

A stacker 46 for receiving a large volume of sheets delivered from the processing station 45 is provided in a vertically movable manner above the plural mail trays 48. Provided in the unit body 52 is a sheet delivering mechanism 49 for delivering a sheet to a designated one of the mail trays 48 or to the stacker 46 on the basis of sheet destination information applied thereto from an information processor.

The sheet delivering mechanism 49 includes a first path switching claw 50 for delivering a sheet switchably to the sheet transportation mechanism 47 or to the stacker 46 on the basis of the sheet destination information, and second path switching claws 51 for delivering the sheet transported thereto via the sheet transportation mechanism 47 switchably to any one of the mail trays 48 on the basis of the sheet destination information. With this arrangement, the sheet handling unit can stack sheets (which may be stapled as required) on the stacker 46, and place sheets respectively carrying images recorded thereon on the basis of print information outputted from different information processors in the respective mail trays 48 for assortment thereof.

With the sheet handling unit of this arrangement, however, plural sheets to be discharged onto the mail tray 48 cannot be subjected to the stapling process.

To overcome this problem, the inventors of the present invention have developed a sheet handling unit 62 as shown in FIG. 14.

This improved sheet handling unit 62 includes a processing station 64 having a sheet stapling mechanism 63 and provided in a vertically movable manner in a unit body 65. A plurality of mail trays 66 are fixed to an upper portion of the unit body 65 in a vertically spaced and tiered relation. A vertically movable stacker 61 is provided below the mail trays 66. Further provided in the unit body 65 are an elevating mechanism for moving up and down the entire processing station 64 and a control unit (not shown) for controlling the elevating mechanism. Sheets are stapled as required, and then discharged to any designated one of the mail trays 66 or to the stacker 61 by moving up or down the processing station 64.

With this arrangement, the sheet handling unit can stack a large volume of optionally stapled sheets on the stacker 61, and discharge stapled sheets in any designated one of the user-specific mail trays 66.

Unfortunately, the improved sheet handling unit 62, which is arranged to move up and down the heavy processing station 64 with the sheet stapling mechanism 63, has a complicated and bulky structure and requires a high-power drive source. Therefore, the unit suffers from significant increase in size and costs.

The sheet handling unit 62 has another drawback that the provision of a sheet sorting mechanism is difficult. More specifically, where plural copies of a single plural-page document are sequentially printed, it is preferred that plural stacks of print-out sheets are discharged discretely on a copy-by-copy basis in a mail tray or stacker. Further, where plural documents are sequentially printed, it is preferred that plural stacks of print-out sheets are discharged discretely on a document-by-document basis in a mail tray or stacker.

A so-called offset sheet discharging mechanism is known as a mechanism serving for this purpose. The offset sheet discharging mechanism is adapted to discharge respective sheet stacks in slightly different discharge positions in a tray for assortment. Addition of such an offset discharging mechanism to the aforesaid sheet handling unit 62 requires a mechanism for shifting the entire processing station 64 in a sheet widthwise direction. This results in an even more complicated construction of the unit and a significant increase in costs.

SUMMARY OF THE INVENTION

It is a first object of the present invention to provide a compact and less expensive sheet handling unit which is capable of discharging optionally stapled sheets onto mail trays and a stacker.

It is a second object of the invention to provide a sheet handling unit which requires a smaller installation space.

In accordance with one aspect of the present invention, there is provided a sheet handling unit which comprises: a unit body; a processing station fixedly provided in the unit body and having a stapling mechanism for stapling a plurality of sheets; a plurality of mail trays fixedly attached to the unit body for receiving sheets transported thereto from the processing station; a bulk tray attached in a vertically movable manner to the unit body for receiving sheets transported thereto from the processing station; and a sheet delivering mechanism for delivering sheets transported thereto from the processing station switchably to any of the mail trays or to the bulk tray.

According to the invention, the sheets optionally subjected to a stapling operation in the processing station can be discharged not only to the bulk tray but also to the mail tray. Since the processing station is fixedly provided in the unit body, there is no need for the provision of an elevating mechanism and a powerful drive source therefor which may otherwise be required for moving the bulky and heavy component. Hence, the unit has a simple and compact construction which avoids the increase in the unit costs.

The sheet delivering mechanism may include a mail-tray sheet transporting mechanism for transporting the sheets transported thereto from the processing station toward the mail trays, a first switching mechanism for delivering the sheets transported thereto from the processing station switchably to the mail-tray sheet transporting mechanism or to the bulk tray, and a second switching mechanism for delivering the sheets transported into the mail-tray sheet transporting mechanism selectively to any of the plural mail trays.

Specifically, the first switching mechanism permits the sheets from the processing station to be transported switchably toward the mail trays or to the bulk tray, while the second switching mechanism permits the sheets transported toward the mail trays to be delivered selectively to any of the plural mail trays.

It is preferred that the switching of the first switching mechanism and the second switching mechanism is controlled by a control unit on the basis of sheet destination information. The sheet destination information designates the bulk tray or any one of the mail trays as the sheet destination. The sheet destination information may be generated, for example, by an information processor such as a personal computer.

Where the sheet handling unit is connected to a network printer shared via a network, for example, the information processor connected to the network supplies the network printer with print data as well as the sheet destination information. The network printer, in turn, inputs the sheet destination information to the control unit of the sheet handling unit, so that the control unit controls the switching of the first and second switching mechanisms on the basis of the information thus inputted thereto.

The processing station preferably further includes a lateral edge aligning mechanism for aligning lateral edges of the sheets, and an offset mechanism for shifting the lateral edge aligning mechanism in a sheet widthwise direction with the lateral edges of the sheets being aligned thereby.

The offset mechanism is operative to shift a sheet discharge position in the sheet widthwise direction for each two consecutive stacks of sheets, for example, when plural copies of a single document are sequentially printed. This makes it possible to discharge plural stacks of print-out sheets discretely in a tray even if the sheet stacks are not subject to the stapling operation.

Since the processing station need not be moved up and down within the unit body in accordance with the inventive arrangement, it is easy to add the offset mechanism to the stationary processing station.

The sheet handling unit may further comprise a special-sheet tray fixedly attached to the unit body for receiving a special sheet other than standard size sheets; a special-sheet transporting mechanism for transporting a sheet introduced into the unit body not via the processing station but directly to the special-sheet tray; and a third switching mechanism for delivering a sheet switchably to the processing station or to the special-sheet tray.

With this arrangement, the standard size sheets are introduced into the processing station, and optionally subjected to the stapling operation. On the other hand, a special sheet of non-standard size bypasses the processing station to be transported to the special-sheet tray by the special-sheet transporting mechanism. This allows for smooth discharge of the special sheet even where the processing station is adapted to accommodate only the standard size sheets.

The aforesaid sheet destination information may be used for designating the special-sheet tray as the sheet destination. More specifically, the control unit of the sheet handling unit may be adapted to control the third switching mechanism on the basis of the sheet destination information which designates the non-standard sheet tray as the sheet destination.

The plurality of mail trays may be attached to an upper portion of the unit body in a vertically spaced and tiered relation. The bulk tray may be disposed in a vertically movable manner below the plurality of mail trays. In this case, two or more bulk trays may be provided.

The special-sheet tray may be a top tray fixed to the unit body above the plurality of mail trays.

It is preferred that the special-sheet tray faces a sheet transportation path of the mail-tray sheet transporting mechanism so that the mail-tray sheet transporting mechanism can deliver the sheets transported thereto from the processing station to the special-sheet tray. Thus, the special-sheet tray also serves for receiving the standard size sheets transported from the processing station.

Such an arrangement is particularly useful when used with an image processing apparatus such as a printer which has a general-purpose tray adapted to receive discharged sheets of any size and a sheet outlet provided separately from the general-purpose tray for feeding sheets to the sheet handling unit. In this case, the provision of the special-sheet tray is not critical because the special sheets may be discharged to the general-purpose tray. In the above arrangement, however, the special-sheet tray can also receive the standard size sheets delivered from the processing station and, hence, is usable as a common non-sort tray belonging to no individual user. If required, the special-sheet tray can also be used as a mail tray belonging to an individual user.

The mail-tray sheet transporting mechanism preferably includes an endless belt which extends along a first transportation path defined along alignment of proximal portions of the plural mail trays and is rotatable in normal and reverse directions, and a first roller which is adapted to hold a sheet between itself and a transport surface of the endless belt opposed to the first transportation path for sheet transportation. It is preferred that the endless belt extends along a second transportation path extending from the third switching mechanism to the special-sheet tray. In this case, the special-sheet transporting mechanism preferably includes a second roller which is adapted to hold a sheet between itself and a transport surface of the endless belt opposed to the second transportation path for sheet transportation.

With this arrangement, the sheet is held between the endless belt and the first roller so as to be transported toward the mail trays by normal rotation of the endless belt. Further, the sheet is held between the endless belt and the second roller so as to be transported toward the special-sheet tray by reverse rotation of the endless belt. Thus, the endless belt can serve for two purposes, contributing to cost reduction of the unit.

The first roller preferably includes a plurality of rollers arranged along the first transportation path in a suitably spaced relation for the transportation of the standard size sheets. Further, the second roller preferably includes a plurality of rollers arranged along the second transportation path in a suitably spaced relation for the transportation of the special sheet (e.g., non-standard size sheet).

The plurality of mail trays may be arranged in a vertically spaced and tiered relation, and the special-sheet tray may be a top tray disposed above the plurality of mail trays. In this case, the endless belt is preferably entrained around a pair of rollers vertically spaced from each other along arrangement of the plurality of mail trays and the top tray. Thus, a surface portion of the endless belt opposed to the plurality of mail trays serves as a transport surface for sheet transportation to the mail trays, and a surface portion of the endless belt opposite from the mail trays serves as a transport surface for sheet transportation to the top tray. The lower one of the pair of rollers may face the third switching mechanism, whereby the sheet fed into the sheet handling unit can be transported switchably to the processing station or to the special-sheet tray.

In accordance with another aspect of the present invention, there is provided a sheet handling unit which is to be attached to a sheet post-processing system including a processing station for performing a predetermined process on sheets, and a sheet stacking section. The sheet handling unit comprises: a unit body attachable to a top of a main body of the sheet post-processing system; a plurality of sheet trays which are each capable of receiving sheets; an internal sheet transporting mechanism for delivering sheets selectively to any of the plural sheet trays; and a path switching mechanism for switching a transport path to guide sheets introduced into the sheet post-processing system to the internal sheet transporting mechanism.

The plurality of sheet trays may be mail trays for receiving sheets each carrying an image recorded thereon on the basis of print data specified by an individual user. In this case, the sheet handling unit serves as a mailbox unit attachable to the sheet post-processing system.

The plurality of sheet trays may be arranged in a vertically spaced and tiered relation.

Further, the processing station may include a stapling mechanism for stapling a plurality of sheets.

Still further, the processing station may perform a post-processing operation on sheets processed by an image processing apparatus. In this case, the post-processing operation may include a stapling operation for stapling a plurality of sheets. The image processing apparatus may be an image forming apparatus such as a printer or a copying machine.

The sheet handling unit of the present invention is attachable to the top of the main body of the sheet post-processing system. Therefore, where the sheet post-processing system is constructed by adding the mailbox unit to a finisher, for example, there will be no increase in the footprint of the system. This obviates the need for re-arrangement of office appliances installed around the system. In the case of the sheet post-processing system initially equipped with the mailbox unit, the system requires quite a small installation space.

The sheet handling unit of the invention can transport the sheet introduced into the sheet post-processing system toward the sheet trays by means of the path switching mechanism, and deliver the sheet to any of the sheet trays by the internal sheet transporting mechanism. Therefore, the mailbox function can be imparted to the image processing apparatus such as a network printer shared via the network. The internal transporting mechanism may be operative to deliver the sheet selectively to any one of the sheet trays on the basis of sheet destination information. In this case, the sheet destination information may be issued by an information processor on the network. The sheet handling unit may, in turn, acquire the sheet destination information via the image processing apparatus so as to operate on the basis of the sheet destination information thus acquired.

The sheet stacking section may include a sheet receiver tray for receiving sheets discharged from a sheet outlet provided in an upper portion of the main body of the sheet post-processing system. In this case, the path switching mechanism may face the sheet outlet.

With this arrangement, the sheets discharged from the sheet outlet can be transported, as required, to any of the sheet trays via the internal transporting mechanism.

The sheet post-processing system may include a switchable sheet delivering mechanism for delivering the sheets introduced into the sheet post-processing system switchably to the processing station or to the sheet receiver tray. The sheet stacking section may include a bulk tray disposed below the sheet receiver tray for receiving the sheets delivered from the processing station. In this case, the bulk tray may be attached in a vertically movable manner to the main body of the sheet post-processing system.

Further, the path switching mechanism may be located in a sheet transportation path extending between a sheet inlet of the sheet post-processing system and the sheet outlet. This arrangement also allows the sheets to be delivered to any of the plurality of sheet trays as required.

Where the sheet post-processing system includes the switchable sheet delivering mechanism for delivering the sheets switchably to the sheet receiver tray or to the processing station, the path switching mechanism is preferably located upstream of the switchable sheet delivering mechanism with respect to a sheet transportation direction in the sheet transportation path.

The sheet post-processing system often has an openable portion provided adjacent the sheet inlet for maintenance thereof. Accordingly, the sheet handling unit can be added to the post-processing system without major modification of the sheet post-processing system by providing the path switching mechanism of the sheet handling unit upstream of the switchable sheet delivering mechanism of the sheet post-processing system.

The foregoing and other objects, features and effects of the present invention will become more apparent from the following description of the preferred embodiments with reference to the attached drawings.

DESCRIPTION OF THE PREFERRED EMBODIMENTS

Figure 1:
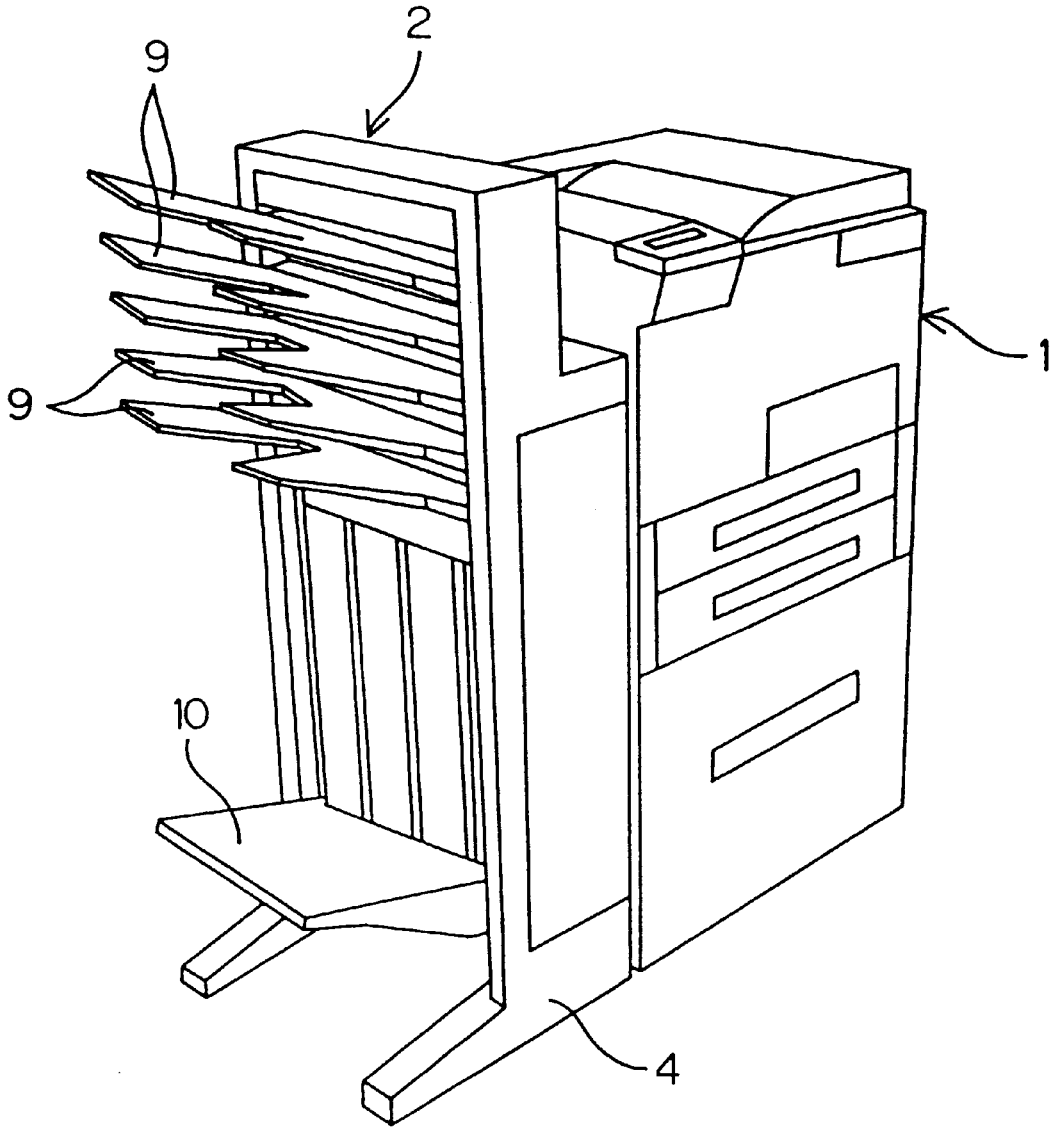
FIG. 1 is a perspective view illustrating a printer equipped with a sheet handling unit according to a first embodiment of the present invention.
Figure 2:
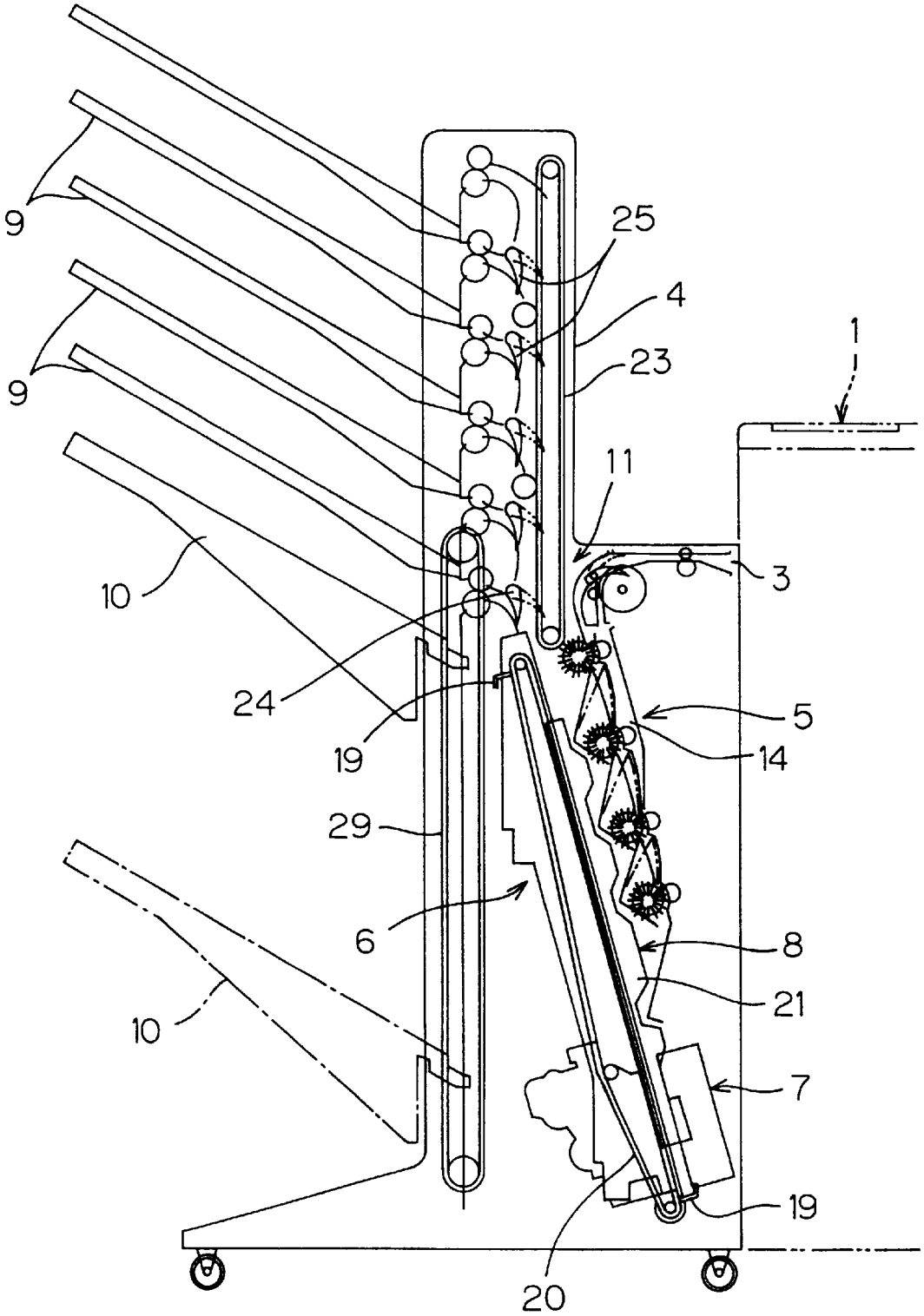
FIG. 2 is a vertical sectional view of the sheet handling unit.

FIG. 1 is a perspective view illustrating the construction of a sheet handling unit 2 of the invention connected to a printer 1 as an exemplary image processing apparatus. FIG. 2 is a sectional view schematically illustrating the internal construction of the sheet handling unit 2. The printer 1 outputs sheets with their faces up which have been subjected to a printing process. The sheet handling unit 2 has a sheet inlet 3 provided in an upper portion of a lateral side thereof opposed to the printer 1. A sheet transporting device 5 for downwardly transporting a sheet is provided in connection to the sheet inlet 3 in a unit body 4. Further, the unit body 4 incorporates therein a processing station 6 for sequentially stacking sheets fed from the sheet transporting device 5. The processing station 6 includes a sheet stapling mechanism 7 for stapling a stack of plural sheets, and a sheet lateral edge aligning mechanism 8.

A plurality of mail trays 9 for receiving sheets discharged from the processing station 6 with their faces up are provided on a lateral side of the unit body 4 opposite from the printer 4. These mail trays 9 are fixedly provided in a vertically spaced and tiered relation. A stacker 10 (bulk tray) capable of holding a large volume of stacked sheets is disposed in a vertically movable manner below the mail trays 9. A sheet delivering mechanism 11 for delivering sheets to a designated one of the mail trays 9 or to the stacker 10 is provided in association with the mail trays 9 and the stacker 10.

Figure 3:
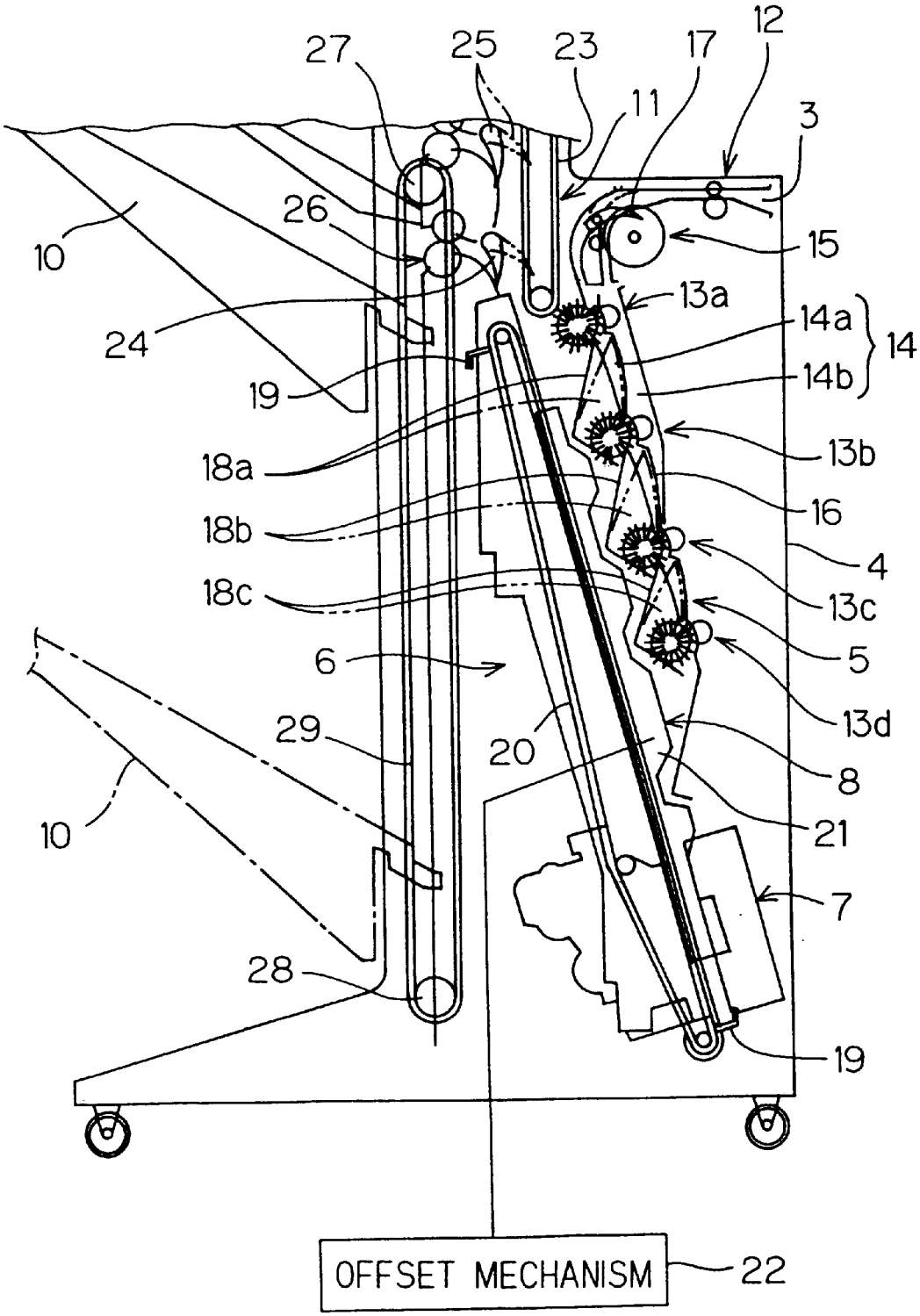
FIG. 3 is a detailed view illustrating a sheet transporting device and a processing station of the sheet handling unit.

As shown in FIG. 3, the sheet transporting device 5 includes a feed roller pair 12 disposed adjacent the sheet inlet 3, a sheet transportation path 14 continuous to the sheet inlet 3 and bent downward, and plural pairs of rollers 13*a* to 13*d* (first to fourth roller pairs in this embodiment) disposed in a spaced relation along the sheet transportation path 14. These roller pairs 13*a* to 13*d* each consist of a brush roller and an assist roller. The sheet transporting device 5 further includes a feed roller pair 15 located at a path deflection portion of the sheet transportation path 14, a transport guide plate 16 for partitioning the sheet transportation path 14 into an inside transportation path 14*a* and an outside transportation path 14*b*, and a path switching claw 17 for advancing a sheet selectively into the inside or outside transportation path 14*a*, 14*b*. The path switching claw 17 is located adjacent the feed roller pair 15. The path switching claw 17 guides a sheet introduced through the sheet inlet 3 into the inside transportation path 14*a* when located in a position shown by a solid line in FIG. 3, and guides the sheet from the sheet inlet 3 into the outside transportation path 14*b* when located in a position shown by a two-dot-and-dash line in FIG. 3.

Path switching claws 18*a* to 18*c* are provided upstream of the second to fourth roller pairs 13*b* to 13*d*, respectively. The path switching claws 18*a* to 18*c* are each switched between a position which allows for passage of a sheet transported via the corresponding upstream roller pair 13*a* to 13*c* and a position which allows for deflection of the transportation path toward the processing station 6. Thus, a minimum size sheet, a small size sheet, a medium size sheet and a large size sheet can be supplied to the processing station 6 via the fourth roller pair 13*d*, the third roller pair 13*c*, the second roller pair 13*b* and the first roller pair 13*a*, respectively.

The processing station 6 includes an intermediate tray comprised of a tilted endless belt 20 having two sheet receiving members 19, 19 attached thereto at a phase difference of 180 degrees. The sheet stapling mechanism 7 is disposed at a lower end of the intermediate tray. The endless belt 20 is rotatively driven to transport a stack of sheets in a direction opposite to the sheet transportation direction in the sheet transport path 14 (in a diagonally upward direction). The rotation of the endless belt 20 is controlled so that either one of the sheet receiving members 19 is located at the lowermost position as seen in FIG. 3 when sheets are to be stacked. In this state, sheets are stacked on the sheet receiving member 19 with their faces down in forward serial page order and, as required, the stack of sheets is subjected to the stapling operation to be stapled at its lower edge portion by the sheet stapling mechanism 7.

The sheet lateral edge aligning mechanism 8 includes a pair of edge aligning cursors 21 capable of holding a maximum width sheet therebetween, and an interlocking mechanism for moving the cursors toward and away from each other in unison. Each time a sheet is stacked on the intermediate tray (endless belt 20), the pair of cursors 21 are moved from a home position which allows for reception of the maximum width sheet to a position which allows for reception of the sheet to be stacked in accordance with sheet size data applied thereto from the printer 1.

The sheet lateral edge aligning mechanism 8 further includes an offset mechanism 22 for reciprocally moving the cursors 21 by a fractional distance in a sheet widthwise direction with lateral edges of the stacked sheets being restricted between the cursors 21. The offset mechanism 22 is operative on the basis of information indicating that the last sheet has been stacked in the processing station 6 and information indicating that the sheets are to be discharged in a sorted manner, onto any one of the mail trays 9 or the stacker 10. The information is generated by an internal control unit of the sheet handling unit 2 associated with a control unit of the printer 1.

Figure 4:
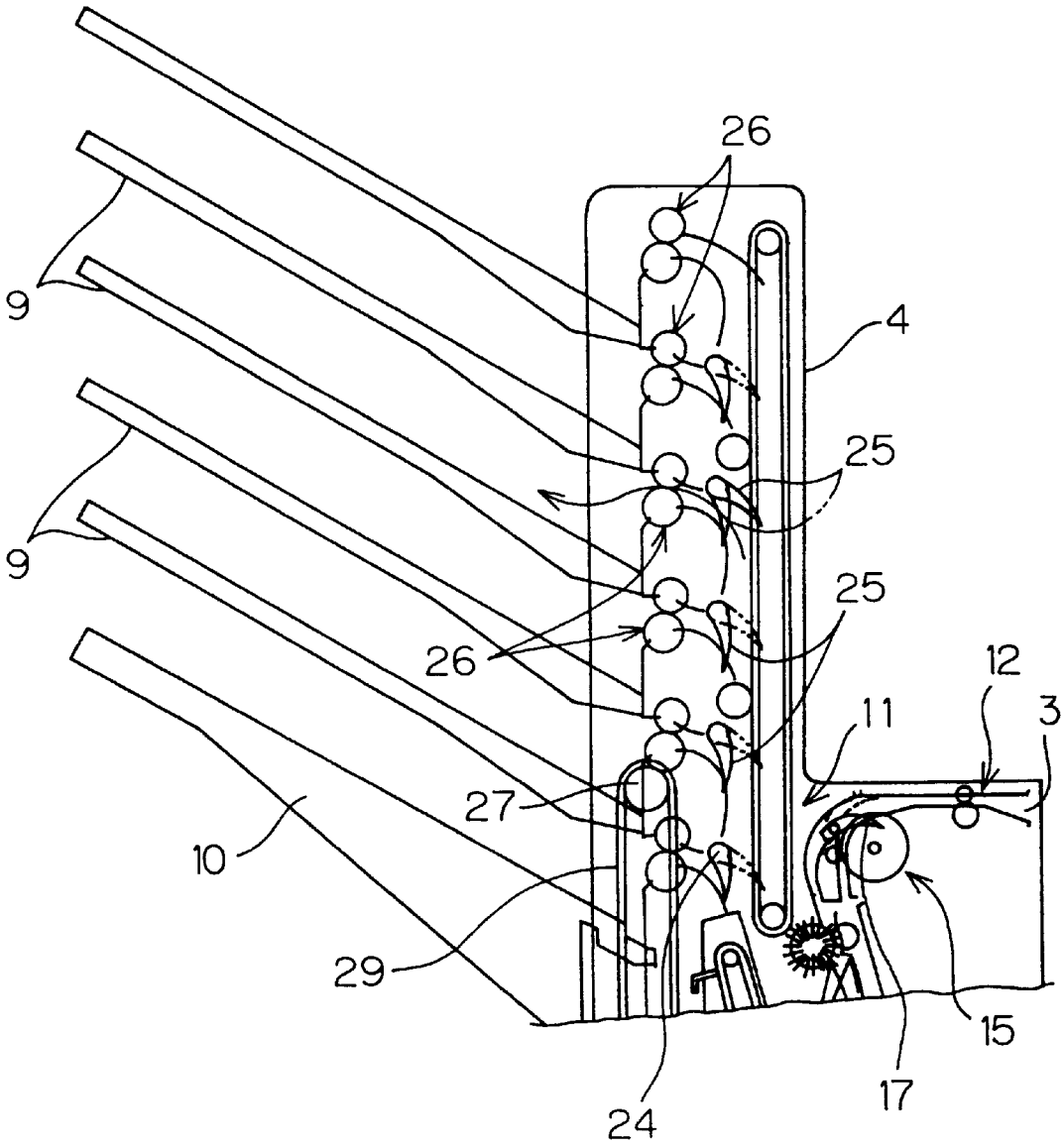
FIG. 4 is a detailed view illustrating an arrangement adjacent to mail trays of the sheet handling unit.

The sheet delivering mechanism 11 includes a path switching claw 24 (first switching mechanism) provided above the endless belt 20 for transporting the sheet stack switchably toward the stacker 10 or toward a mail-tray sheet transporting mechanism 23 which transports the sheet stack toward the mail trays 9. As shown in FIG. 4, the sheet delivering mechanism 11 further includes a plurality of path switching claws 25 (second switching mechanism) respectively provided upstream of feed roller pairs 26 for the respective mail trays 9 for delivering the sheet stack switchably to any designated one of the mail trays 9 from the mail-tray sheet transporting mechanism 23. It is noted that no path switching claw 25 is provided for the uppermost mail tray 9. The path switching claws 24, 25 each assume a position (shown by a solid line in FIG. 2) which allows for upward passage of the sheet stack (toward the downstream side with respect to the sheet transportation direction), for example, as a home position. The home positions of the path switching claws 24, 25 may be set at any positions for convenience of the unit design and the like.

The stacker 10 is attached to a plurality of toothed endless belts 29 entrained around a pair of pulleys 27, 28 disposed in a vertically spaced relation in the unit body 4. A torque is applied to either one of the pulleys 27, 28 by a rotary drive mechanism (not shown). The rotary drive mechanism is operative to lower the stacker 10 according to the number of sheets discharged onto the stacker 10. This makes it possible to stack a large volume of sheets on the stacker 10.

Figure 5:
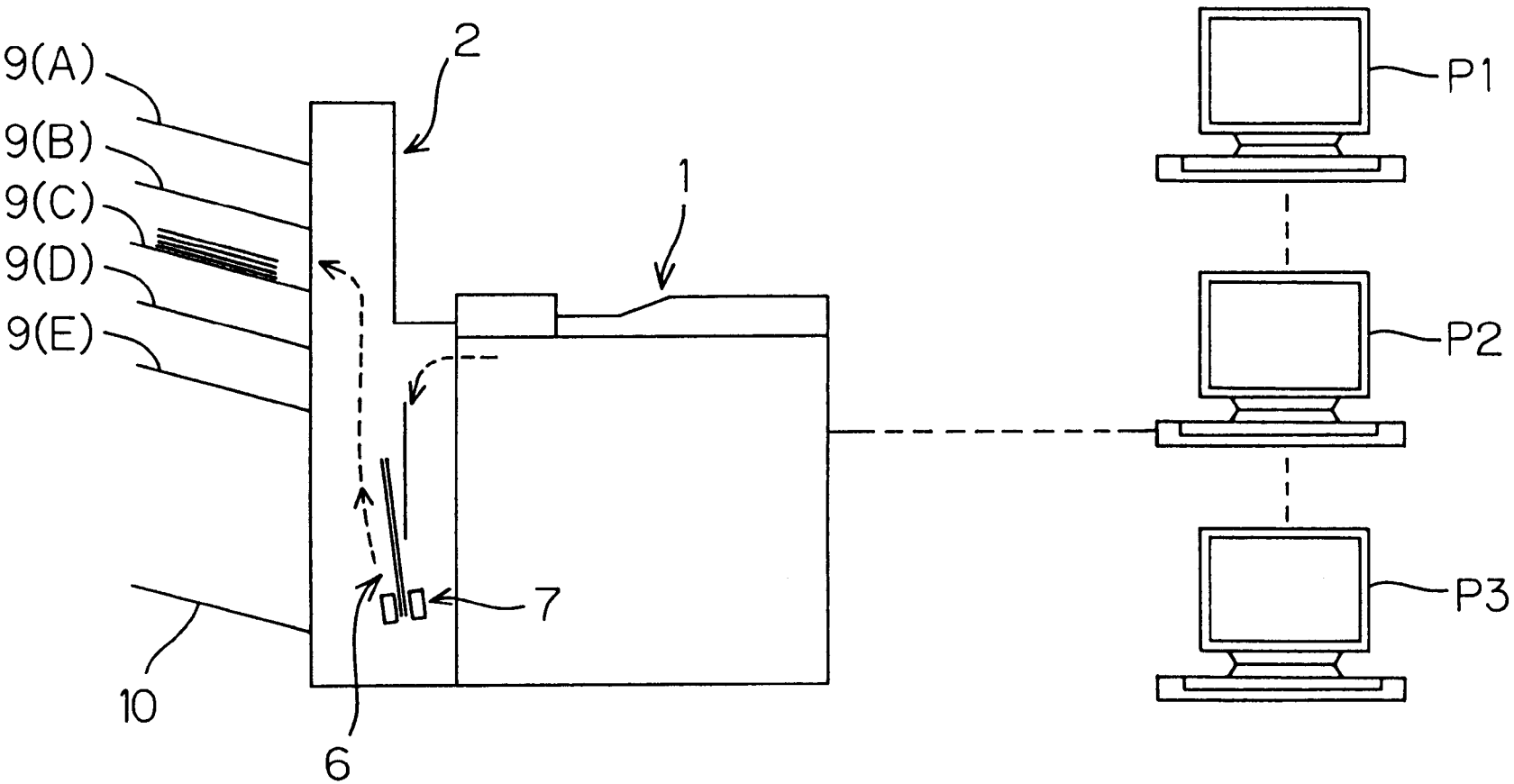
FIG. 5 is a network connection diagram illustrating a network connection to the printer.

It is herein assumed, for example, that a plurality of personal computers P1 to P3 are connected to the single printer 1 via network and the printer is shared by Users A to E, as shown in FIG. 5. An explanation will be given to a case where User C requests to print one copy of a single plural-page document, subject a stack of print-out sheets to the stapling operation and deliver the stapled sheet stack to the third mail tray 9 from the top.

Sheets fed from the printer 1 are sequentially stacked one on another in the processing station 6 by means of the sheet transporting device 5, while the lateral edge aligning mechanism 8 aligns lateral edges of stacked sheets at each sheet stacking. Upon completion of the stacking of the specified number of sheets, the internal control unit of the sheet handling unit 2 generates last-sheet stack information indicating that the last sheet has been stacked. In response thereto, the sheet stapling mechanism 7 staples the stack of sheets.

In the sheet handling unit 2, only one of the path switching claws 25 corresponding to the third mail tray 9 is switched to a position as shown by a solid line in FIG. 4 to deliver the sheet stack to the third mail tray 9 on the basis of sheet destination information applied thereto from the personal computer P1. Then, the endless belt 20 of the processing station 6 is actuated in response to the aforesaid last-sheet stack information, thereby delivering the stapled sheet stack to the third mail tray 9.

Where plural copies of a single plural-page document are sequentially printed in a collated manner, plural stacks of print-out sheets are discharged by repeatedly performing the aforesaid sheet discharge process on the basis of copy number specifying information applied from the personal computer P1.

Where a plurality of documents are sequentially printed, plural stacks of print-out sheets are discharged on a document-by-document basis by repeatedly performing the aforesaid sheet discharge process on the basis of information applied from the personal computer P1 for specifying the sequential printing of the plural documents and information indicative of completion of each document printing.

If offset sheet discharge information is applied as required, the plural stacks of print-out sheets are discharged discretely on a stack-by-stack basis in the mail tray 9 by the operation of the offset mechanism 22. The offset sheet discharging process will be described later in detail.

Similarly to the sheet delivery to the mail trays 9, the sheet delivery to the stacker 10 is based on tray designation information (sheet destination specifying information) applied from the personal computer. While the mail trays 9 are used on a user-specific basis, the stacker 10 is used as a common stacker belonging to no individual user. That is, the stacker 10 is available to any of the users who desires to output a large volume of print-out sheets. The print-out sheets can be sorted if a plurality of such stackers 10 are attached to the belt 29. The sheet delivery to the stackers 10 may be started with the lowermost one of the stackers 10.

Next, an explanation will be given to a case where plural copies of a single plural-page document are sequentially printed in a collated manner and plural stacks of print-out sheets in an unstapled state are discharged onto the stacker 10 through an offset sheet discharge process.

In any sheet stack discharge processes, sheets fed from the printer 1 via the sheet transporting device 5 are stacked one on another in the processing station 6, and lateral edges thereof are aligned by the lateral edge aligning mechanism 8 at each sheet stacking.

In the sheet handling unit 2, the path switching claw 24 of the sheet delivering mechanism 11 is switched to the position which allows for sheet transportation toward the stacker 10 on the basis of the designation of the stacker 10 by a user from the personal computer. Upon completion of stacking of the specified number of sheets, the endless belt 20 of the processing station 6 is actuated in response to the last-sheet stack information. Thus, the stacked sheets which are unstapled but with their lateral edges being aligned are directly discharged onto the stacker 10.

In the meantime, sheets are sequentially stacked in the processing station 6 to form the subsequent sheet stack while being subjected to the lateral edge aligning process. Upon completion of stacking of the specified number of sheets, the control unit generates the last-sheet stack information indicative of the completion of the stacking. If the offset sheet discharge process is designated, the offset mechanism 22, in response to the last-sheet stack information, shifts the cursors 21 by the fractional distance in one direction along the sheet width together with the stack of sheets with lateral edges thereof being aligned. More specifically, the offset mechanism 22 shifts the pair of cursors 21, which hold therebetween the sheet stack for the lateral edge alignment, between a home position and an offset position located apart from the home position by the predetermined distance in the one direction along the sheet width.

With a time lag following the sheet offset process, the endless belt 20 of the processing station 6 is actuated in response to the last-sheet stack information. Thus, the sheet stack slightly shifted in the one direction along the sheet width is discharged in an offset state onto the stacker 10. Subsequently, the sheet discharging operations with the cursors 21 located at the home position and with the cursors 21 located at the offset position are alternately performed until the last one of the sheet stacks is discharged. Thus, the plural stacks of sheets are discharged discretely on a stack-by-stack basis onto the stacker 10, thereby facilitating the subsequent sheet assortment operation.

FIGS. 6 to 10 illustrate the construction of a sheet handling unit 2A according to a second embodiment of the invention. As the sheet handling unit 2A has a construction similar to the sheet handling unit according to the first embodiment, components corresponding to those shown in FIGS. 1 to 5 are denoted by the same reference characters in FIGS. 6 to 10, and no explanation will be given thereto. It is however noted that the components denoted by the same reference character do not necessarily have the identical construction.

Figure 6:
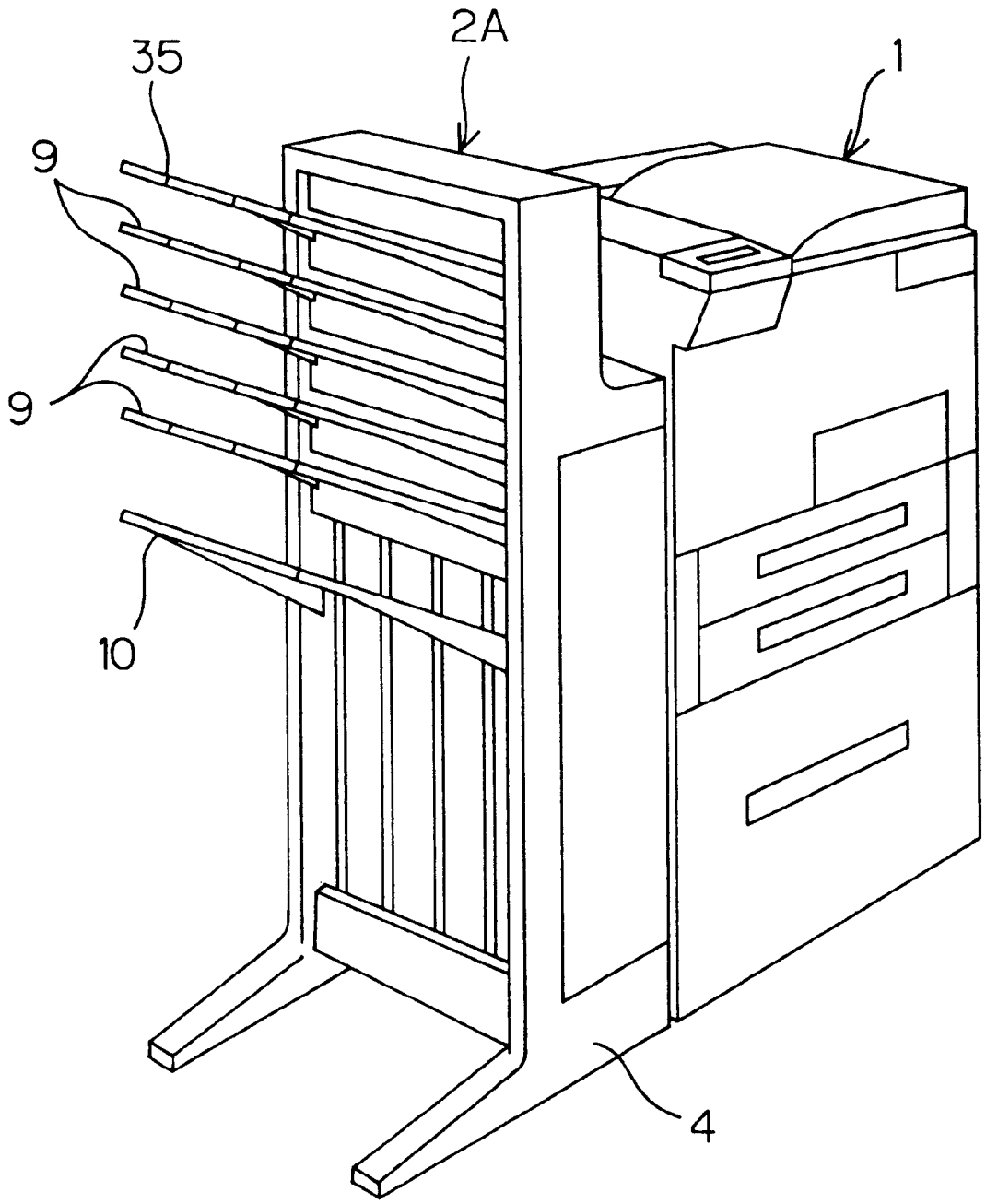
FIG. 6 is a perspective view illustrating a printer equipped with a sheet handling unit according to a second embodiment of the invention.
Figure 7:
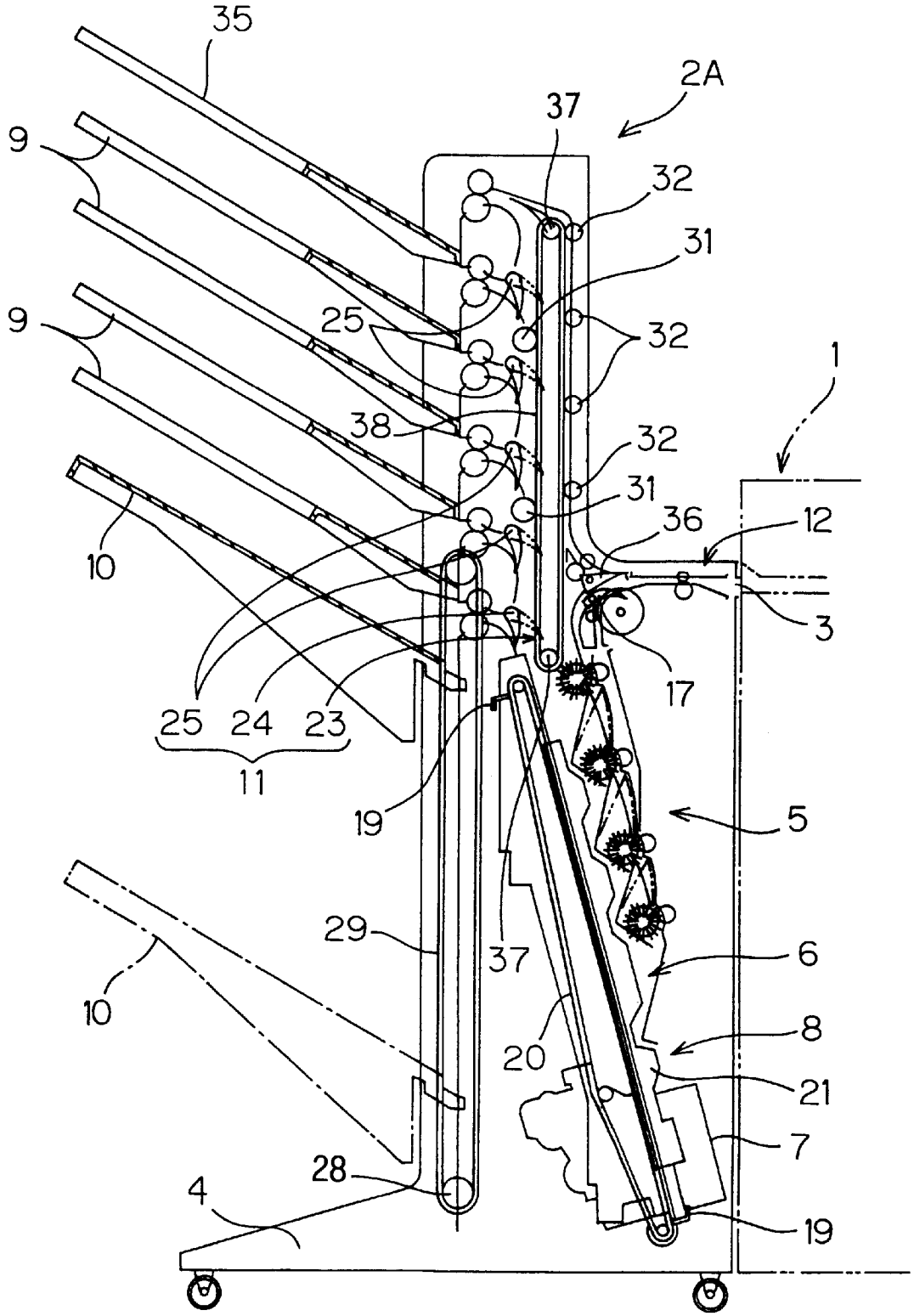
FIG. 7 is a vertical sectional view of the sheet handling unit of FIG. 6.
Figure 8:
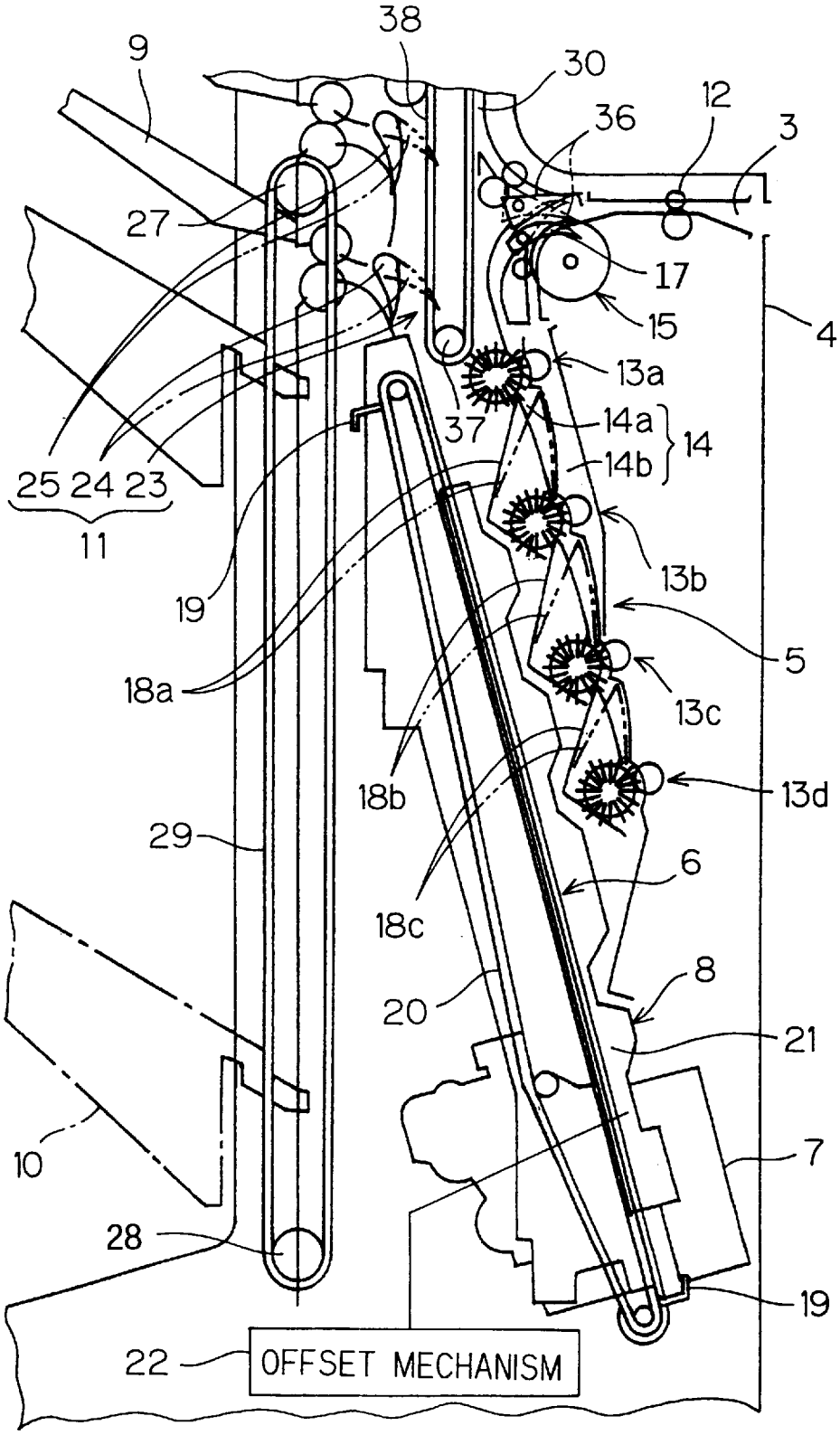
FIG. 8 is a detailed view illustrating a sheet transporting mechanism and a processing station of the sheet handling unit of FIG. 6.

As shown in FIG. 6, the sheet handling unit 2A has a top tray 35 (special-sheet tray) provided above the mail trays 9 arranged in a vertically spaced and tiered relation. The top tray 35 serves as a so-called non-sort tray for receiving special sheets such as non-standard size sheets. The special sheets include postcards, envelopes and the like in addition to the non-standard size sheets.

A path switching claw 36 (third switching mechanism) for deflecting a sheet toward a special-sheet transporting mechanism 30 for sheet transportation toward the top tray 35 is provided adjacent the feed roller pair 15. The path switching claw 36 is pivotal between positions shown by a solid line and by a dot line in FIGS. 8 and 9. The position indicated by the solid line is a normal position for guiding the sheet to the processing station 6, while the position indicated by the dot line is a top-tray sheet delivering position for guiding the sheet to the top tray 35.

The special-sheet transporting mechanism 30 includes an endless belt 38 entrained around a pair of rollers 37, 37 respectively located adjacent a top portion of the endless belt 38 and above a proximal portion of the top tray 35. An outer surface portion of the endless belt 38 facing the mail trays 9 defines a first transportation path, while an outer surface portion thereof opposite from the mail trays 9 defines a second transportation path.

The special-sheet transporting mechanism 30 further includes a plurality of driven rollers 32 provided in a spaced relation in abutment against the outer surface portion of the endless belt 38 opposite from the top tray 35 and the mail trays 9 (the outer surface portion thereof facing the second transportation path and defining a special-sheet transport surface). These driven rollers 32 (second roller) are arranged at a suitable pitch for transportation of special sheets such as non-standard size sheets, postcards and envelopes.

One of the pair of rollers 37, 37 is a drive roller supplied with a torque by a rotary drive mechanism not shown, while the other roller is a driven roller following the rotation of the endless belt 38. The drive roller is adapted to be rotated in normal and reverse directions by the rotary drive mechanism so that the endless belt 38 can accordingly be rotated in the normal and reverse directions. It is herein defined that rotation of the endless belt 38 by which the portion of the endless belt 38 adjacent to the driven rollers 32 is moved upward is the reverse rotation and rotation of the endless belt 38 in the opposite direction is the normal rotation.

When the drive roller is driven for the reverse rotation of the endless belt 38, the sheet is held between the endless belt 38 and the driven rollers 32 to be transported upward and delivered to the top tray 35 via the crest of the endless belt 38.

A plurality of driven rollers 31 (first roller) are provided in a spaced relation in press contact with the outer surface portion (defining a standard-size sheet transport surface) of the endless belt 38 on the side of the mail trays 9. When the aforesaid drive roller is driven for the normal rotation of the endless belt 38, the portion of the endless belt 38 on the side of the driven rollers 31 is moved upward so that a sheet stack from the processing station 6 can be transported upward. The sheet stack can be delivered to any one of the mail trays 9 designated by the information processor by switching the corresponding one of the path switching claws 25 to the position indicated by the dot line in FIG. 9. Thus, the mail-tray sheet transporting mechanism 23 for sheet transportation toward the mail trays 9 is constituted by the endless belt 38, the driven rollers 31 and the like. In the first embodiment, the mail-tray sheet transporting mechanism 23 has substantially the same construction as in the second embodiment, but the endless belt 38 is not required to be capable of normal and reverse rotation.

Figure 10:
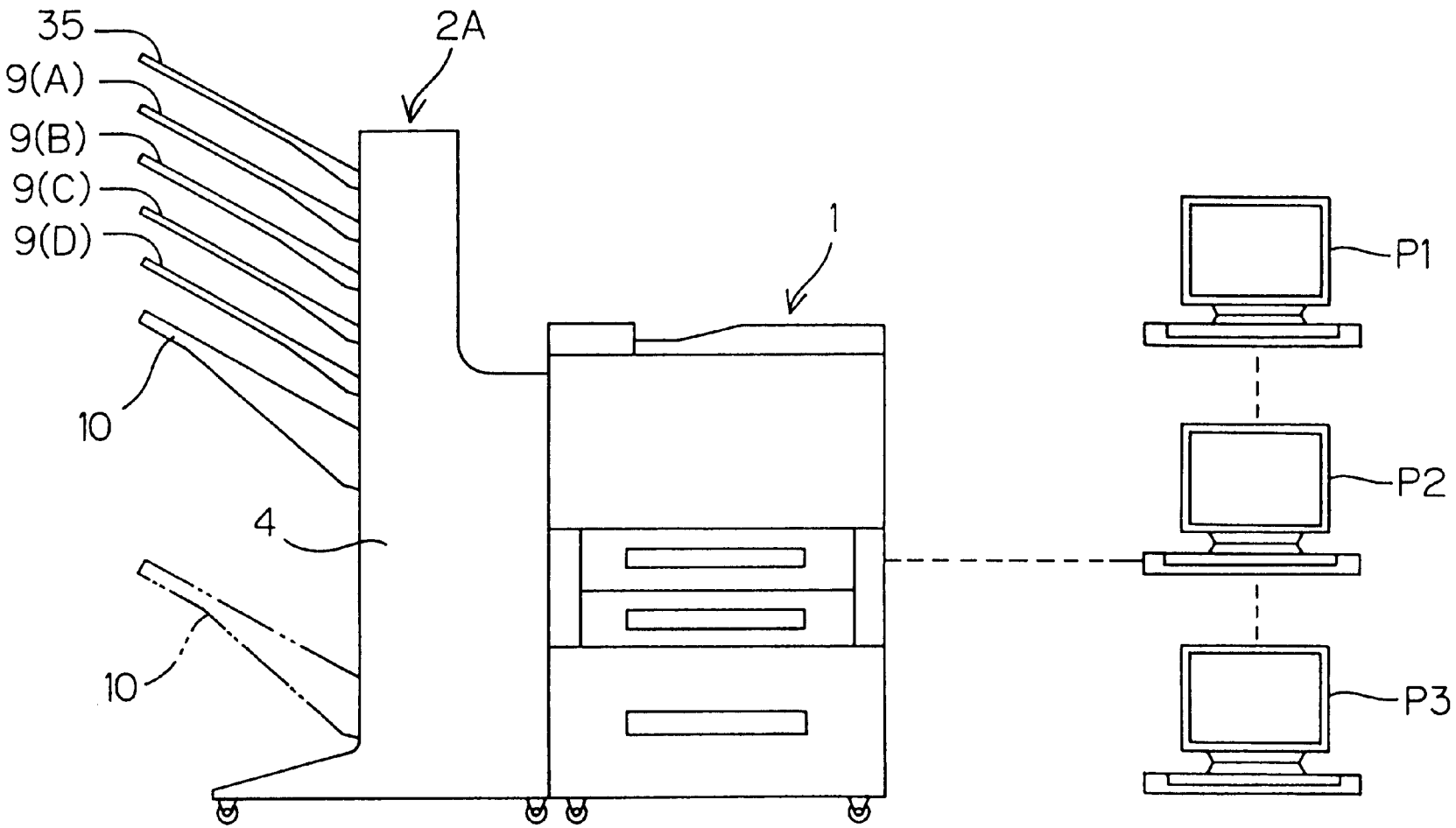
FIG. 10 is a network connection diagram illustrating a network connection to the printer of FIG. 6.

It is herein assumed, for example, that a plurality of information processors (e.g., personal computers) P1, P2, P3 are connected to the single printer 1 via network as shown in FIG. 10. An explanation will be given to a case where the printer 1 is shared by Users A to D and User A requests, for example, to print one copy of a single plural-page document on standard size sheets, subject a stack of print-out sheets to the stapling operation and discharge the stapled sheet stack onto the uppermost mail tray 9.

First, standard size sheets sequentially discharged with their faces up from the printer 1 in forward serial page order are transported via the sheet transporting device 5, and stacked in the processing station 6 with their faces downwardly tilted. The lateral edge aligning mechanism 8 performs the lateral edge aligning operation at each sheet stacking. Upon completion of stacking of the specified number of sheets, the control unit (not shown) of the sheet handling unit 2A generates last-sheet stack information and, in response thereto, the sheet stapling mechanism 7 staples the sheet stack, for example, at an upper left corner thereof.

Figure 9:
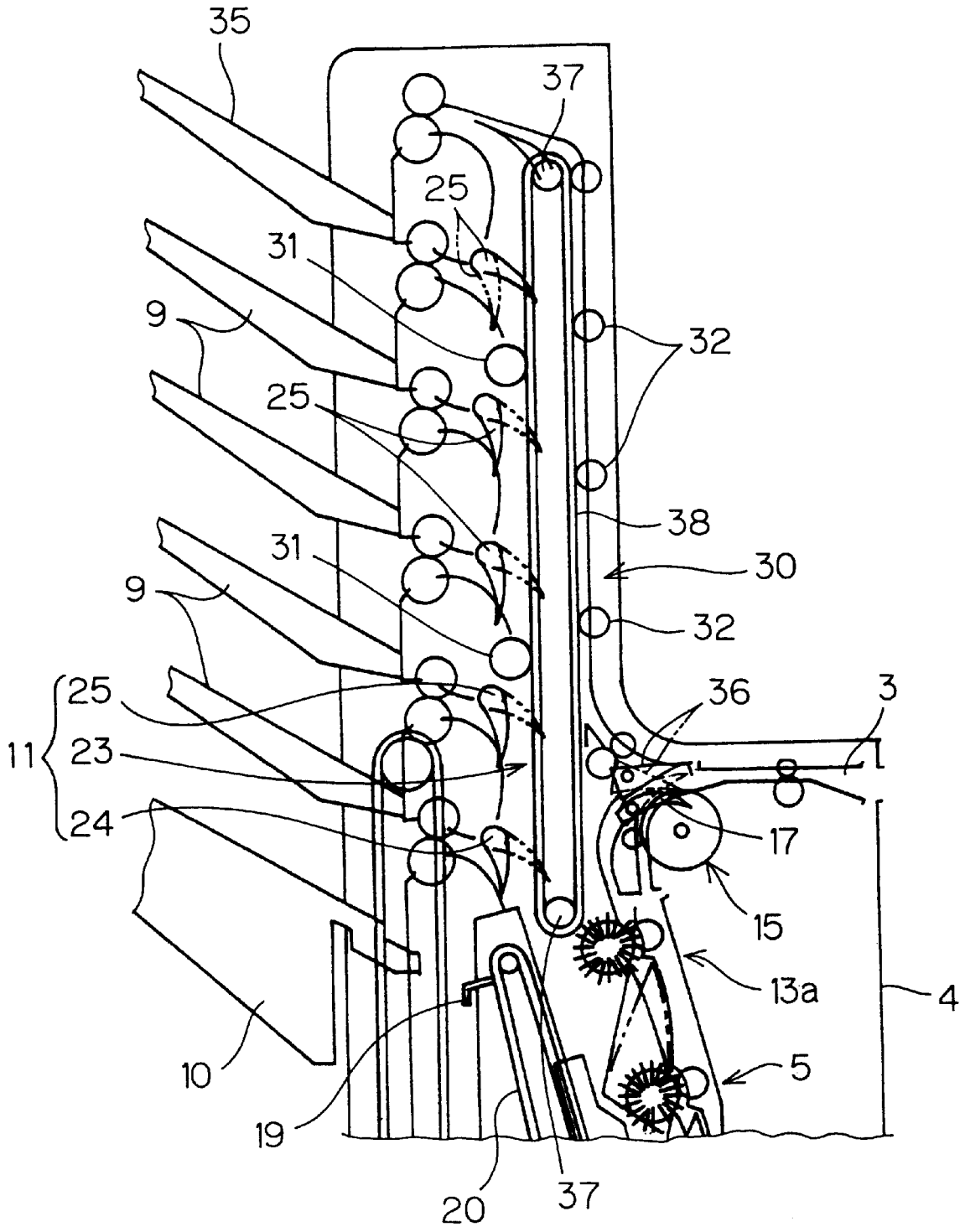
FIG. 9 is a detailed view illustrating an arrangement associated with mail trays of the sheet handling unit.

In the sheet delivering mechanism 11, only one of the path switching claws 25 corresponding to the uppermost mail tray 9 is switched to the sheet feeding position shown by the solid line in FIG. 9 on the basis of sheet destination information applied thereto from the information processor of User A. In response to the information indicative of the completion of the sheet stapling operation, the endless belt 20 of the processing station 6 is actuated for the normal rotation, whereby the stapled sheet stack is discharged to the uppermost mail tray 9 with its face up.

Like the stacker 10, the top tray 35 is used as the non-sort tray belonging to no individual user. There are two sheet delivery processes for sheet delivery to the top tray 35.

A first sheet delivery process is selected when delivery of a stack of standard size sheets to the top tray 35 is requested via the information processor. In this case, the stack of standard size sheets transported from the processing station 6 is further transported by the mail-tray sheet transporting mechanism 23 to be discharged onto the top tray 35 on the basis of the sheet destination information.

A second sheet delivery process is carried out when the information processor issues sheet destination information which specifies delivery of special sheets to the top tray 35. In this case, the path switching claw 36 is switched toward the special-sheet transporting mechanism 30 on the basis of the sheet destination information thus issued. Then, the endless belt 38 is driven for the reverse rotation. Thus, the special sheets fed from the printer 1 are delivered to the top tray 35 via the special-sheet transporting mechanism 30.

Where the printer 1 has a general-purpose sheet discharge tray for receiving sheets discharged to an upper portion of the printer body, it is not always necessary to provide the top tray 35 for receiving the special sheets. Since the sheet handling unit 2A of this embodiment is constructed so that standard size sheets can also be discharged to the top tray 35, the top tray 35 is not needless. That is, the sheet handling unit 2A is advantageously applicable to both an image processor having only a sheet inlet to the sheet handling unit and an image processor having such a sheet inlet as well as a general-purpose tray provided in an upper portion of its main body for receiving special sheets.

Figure 11:
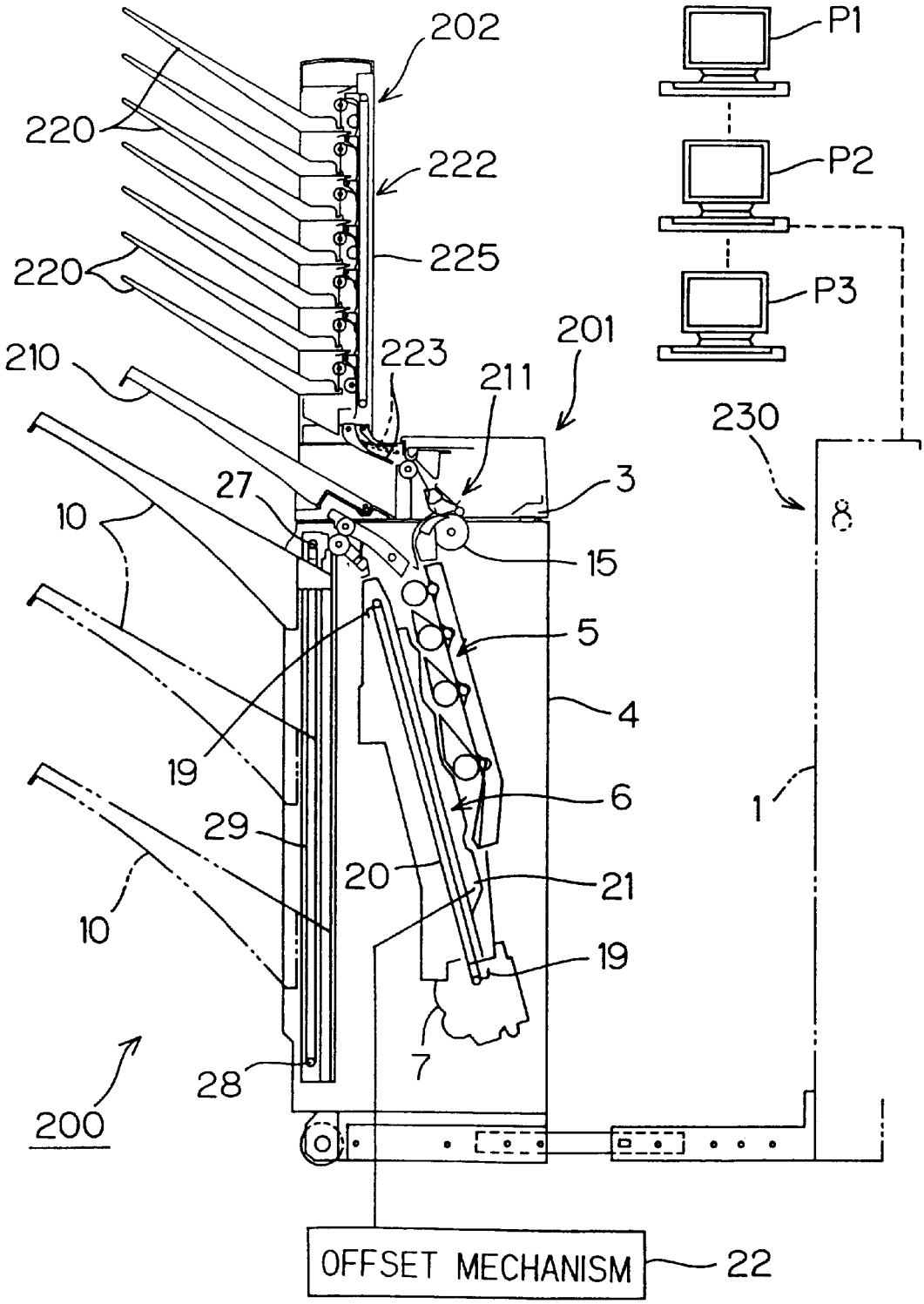
FIG. 11 is a sectional view illustrating the construction of a sheet handling unit according to a third embodiment of the invention.
Figure 12:
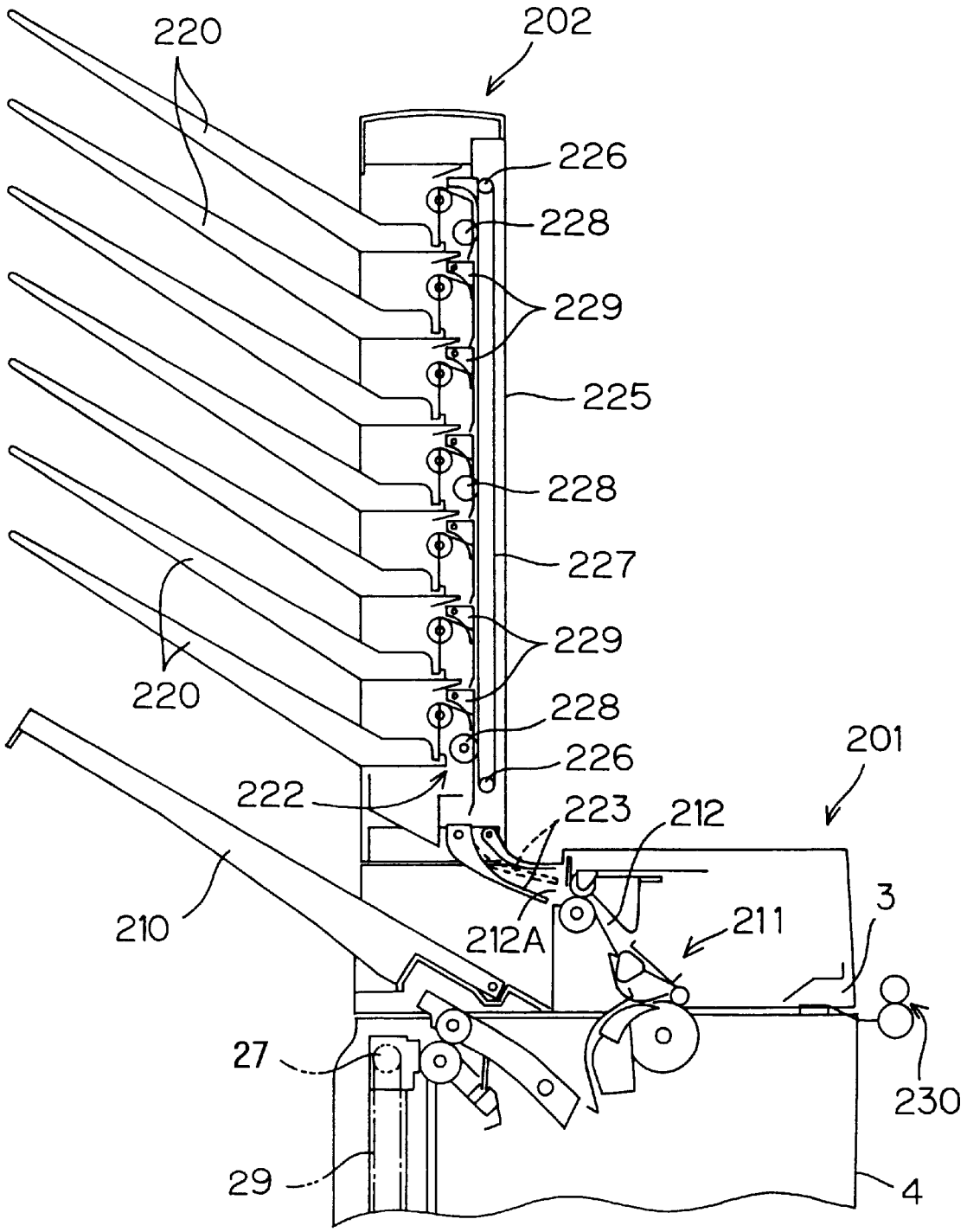
FIG. 12 is a vertical sectional view illustrating a mailbox unit added to a sheet post-processing system shown in FIG. 11.
Figure 13:
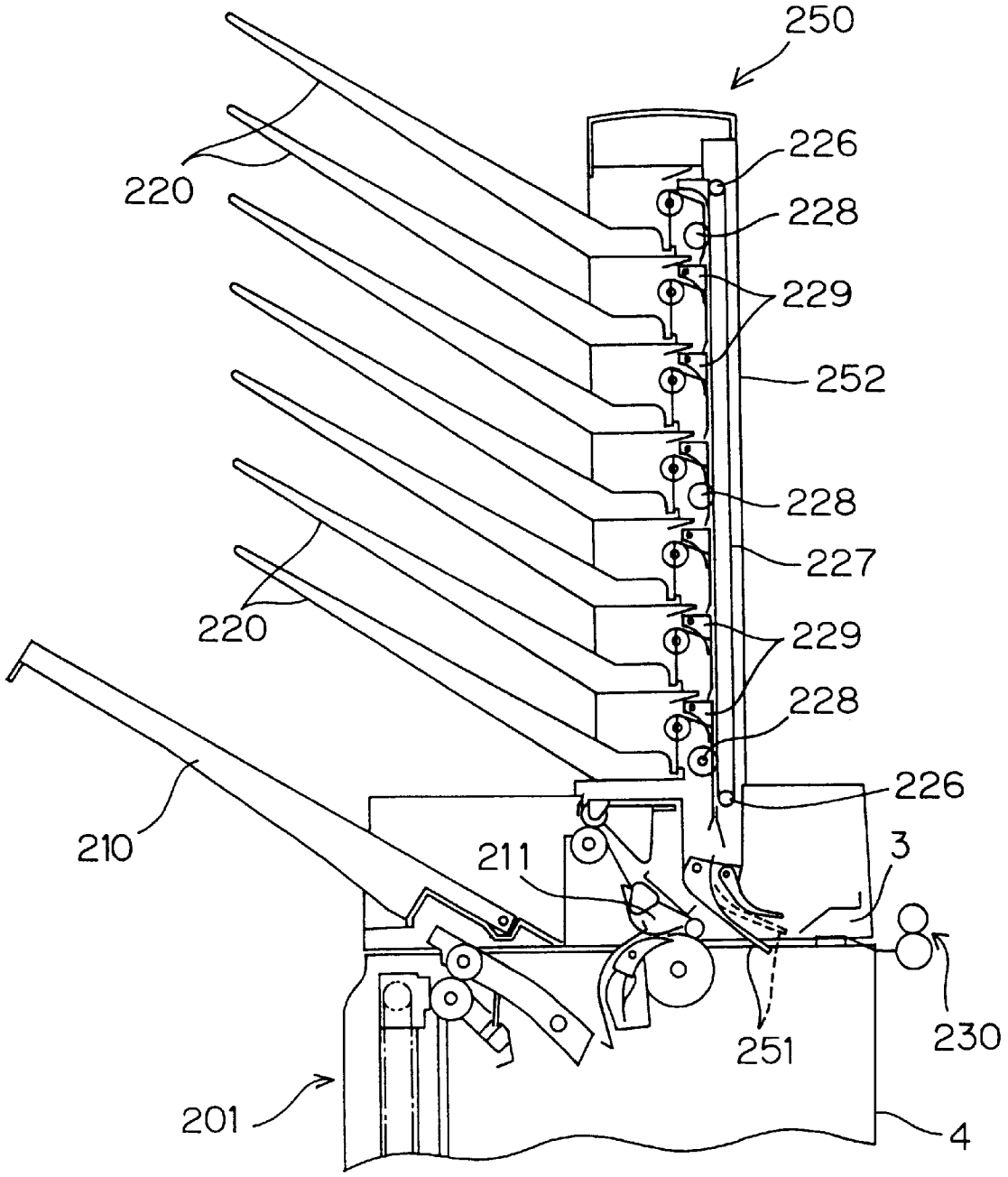
FIG. 13 is a vertical sectional view illustrating a portion of a mailbox unit according to still another embodiment of the invention.
Figure 14:
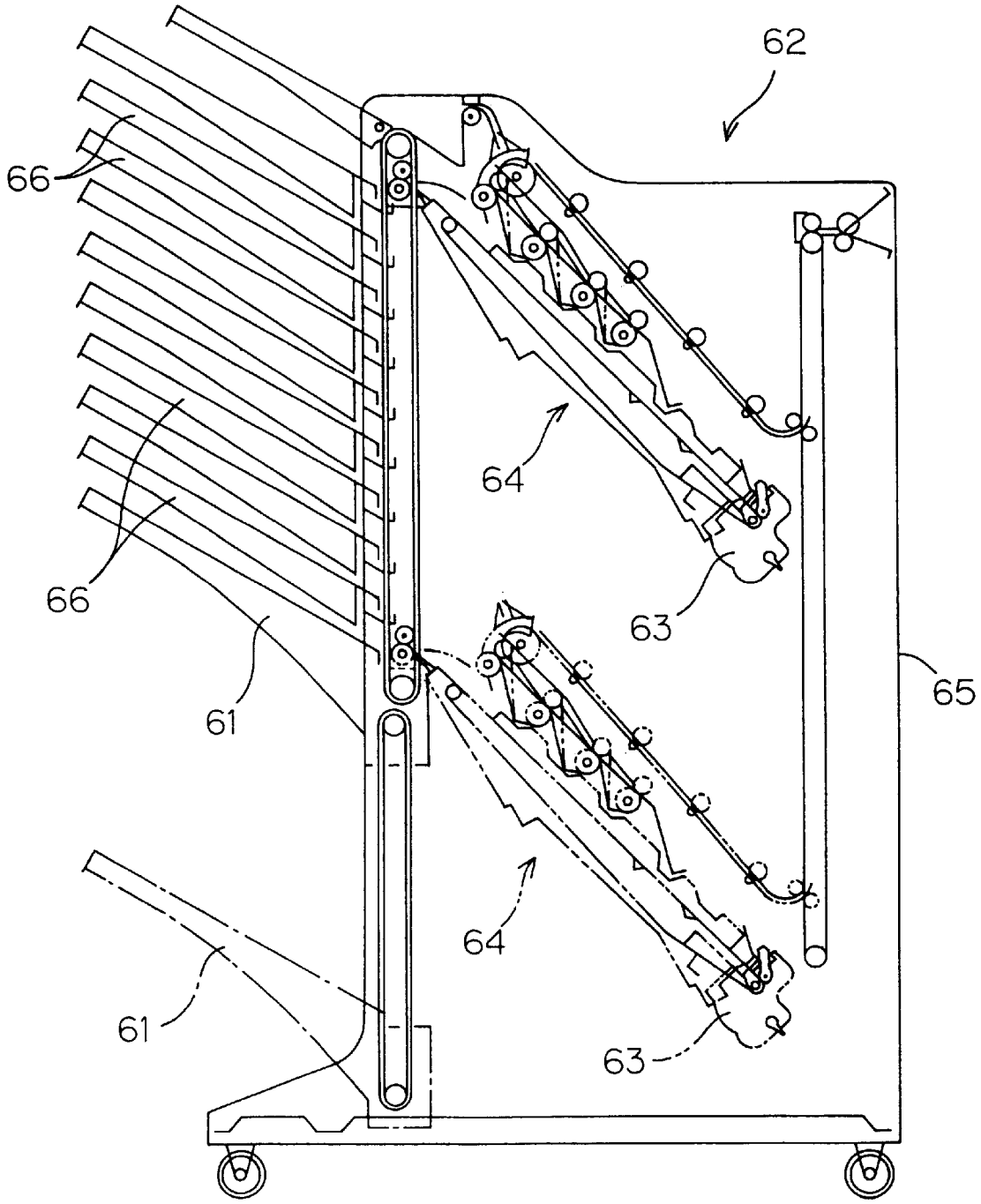
FIG. 14 is a sectional view illustrating a sheet handling unit previously developed by the inventors of the present invention.
Figure 15:
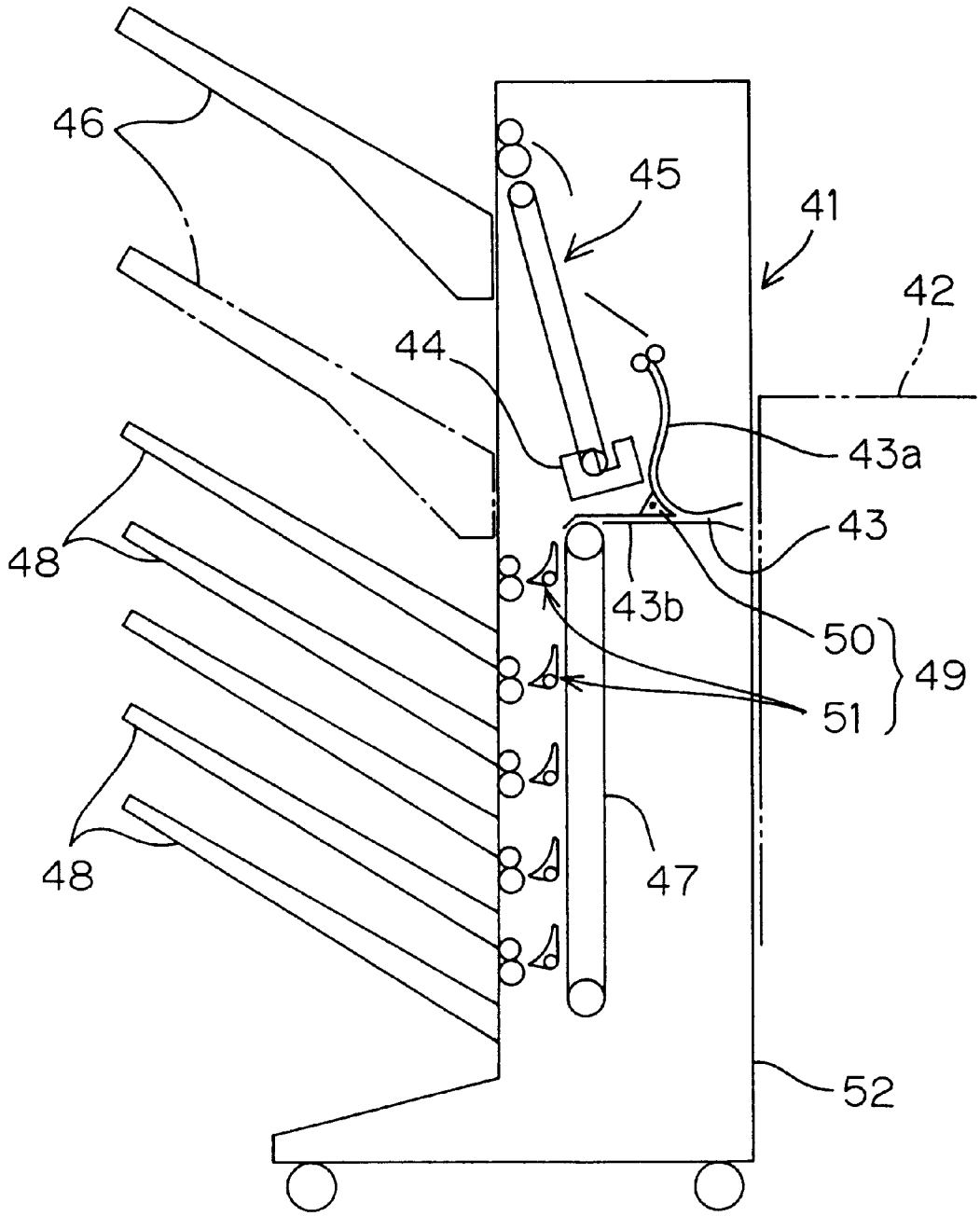
FIG. 15 is a sectional view illustrating a sheet handling unit of the prior art.

Now referring to FIGS. 11 to 13, a third embodiment of the invention will be described. In FIGS. 11 to 13, components corresponding to those shown in FIGS. 1 to 5 are denoted by the same reference characters, and no explanation will be given thereto. It is however noted that the components denoted by the same reference character do not necessarily have the identical construction.

A sheet handling system 200 of this embodiment includes a finisher 201 (sheet post-processing unit) which receives a sheet introduced from a sheet outlet 230 of the printer 1, and a mailbox unit 202 (sheet handling unit) which is independent from the finisher 201. The finisher 201 may be used on a stand-alone basis or be equipped with the mailbox unit 202. The mailbox unit 202 has a unit body 225 which is attachable to the top of a main body 4 of the finisher 201.

In this embodiment, the finisher 201 has a stacker 10 (sheet stacking section) as well as a sheet receiver tray 210 (sheet stacking section) fixed to an upper portion of the main body 4 opposite from a sheet inlet 3. A path switching claw 211 (switchable sheet delivering mechanism) for delivering a sheet switchably to a processing station 6 or to the sheet receiver tray 210 is provided adjacent a feed roller pair 15. A sheet discharge path 212 extends diagonally upward from the path switching claw 211, so that the sheet is discharged to the sheet receiver tray 210 through an exit 212A (sheet outlet) of the sheet discharge path 212.

Sheets processed in the processing station 6 are discharged solely to the stacker 10 and, therefore, cannot be discharged to the sheet receiver tray 210 nor to the mailbox unit 202.

The mailbox unit 202 includes, in its unit body 225, a plurality of mail trays 220 vertically arranged, a sheet transporting mechanism 222 (internal sheet transporting mechanism) for delivering a sheet selectively to any specified one of the mail trays 220 on the basis of sheet destination information applied thereto by a user via any of the information processors (e.g., personal computers) P1 to P3, and a path switching claw 223 (path switching mechanism) for delivering a sheet from the sheet discharge path 212 switchably to the sheet receiver tray 210 or to the mailbox unit 202. The unit body 225 is fixedly mounted on the top of the finisher 201 by means of a fixing member not shown.

The sheet transporting mechanism 222 includes a pair of rollers 226 located adjacent the path switching claw 223 and adjacent a proximal portion of the uppermost mail tray 220, respectively, and an endless belt 227 entrained around the pair of rollers 226. A plurality of feed rollers 228 are provided in a spaced relation in press contact with an outer surface portion of the endless belt 227 on the side of the mail trays 220. Either one of the pair of rollers 226, 226 is a drive roller, while the other roller is a driven roller following the rotation of the endless belt 227. The drive roller is driven to rotate the endless belt 227 in such a direction as to move upward the surface portion of the endless belt 227 on the side of the mail trays 220, whereby a sheet is held between the endless belt 227 and the feed rollers 228 to be transported upward.

Sheet feeding claws 229 are respectively provided adjacent the proximal portions of the mail trays 220. The sheet feeding claws 229 are responsive to the sheet destination information applied thereto from any of the information processors P1 to P3 for designating a mail tray as a sheet destination, and adapted to be switched for sheet delivery to the designated mail tray 220. The sheet feeding claws 229 each assume a position which allows for sheet passage toward the downstream side (i.e., upward sheet passage) as a home position. The home positions of the sheet feeding claws 229 may be set at any positions for convenience of the unit design and the like.

With this arrangement, the switching of the path switching claw 211 is controlled on the basis of the sheet destination information applied from any of the information processors P1 to P3 via the printer 1 so that the sheet from the printer 1 is transported either toward the sheet receiver tray 210 or to the processing station 6. Subsequent to the processing in the processing station 6, a stack of sheets are discharged to the stacker 10.

The sheet delivery process is performed in the following manner on the basis of the sheet destination information applied from any of the information processors P1 to P3, when the control for the sheet discharge process is interrupted or completed.

It is herein assured that a plurality of information processors P1 to P3 are connected to the single printer 1 via network and the printer 1 is shared by a plurality of users, as shown in FIG. 11. Where one of the users requests to discharge plural print-out sheets of a single document onto the third tray 220 from the top, for example, the path switching claw 211 of the finisher 201 is switched for sheet transportation toward the sheet receiver tray 210. On the other hand, the path switching claw 223 of the mailbox unit 202 is switched for sheet transportation toward the sheet transporting mechanism 222. Further, only one of the sheet feeding claws 229 corresponding to the third mail tray 220 from top is switched to the sheet feeding position. Thus, the plural print-out sheets are discharged to the third mail tray 220.

Where plural copies of a single plural-page document are sequentially printed, the aforesaid sheet discharge process is repeatedly performed on the basis of copy number specifying information applied from any of the information processors P1 to P3. Where a plurality of documents are sequentially printed, the sheet discharge process is repeated for each document on the basis of information applied from any of the personal computers P1 to P3 for specifying the sequential printing of the plural documents and information indicative of completion of each document printing.

The sheet delivery to the sheet receiver tray 210 or to the stacker 10 is based on information applied from the printer 1 or any of the information processors P1 to P3. While the mail trays 220 are used on a user-specific basis, the sheet receiver tray 210 and the stacker 10 are used as common trays belonging to no individual user.

This embodiment utilizes an open space above the sheet receiver tray 210 to mount the mailbox unit 202 on the finisher 201 with the path switching claw 223 of the mailbox unit 202 facing the sheet outlet to the sheet receiver tray 210. Therefore, a major modification of the finisher 201 is not required for mounting the mailbox unit 202 on the finisher 201. However, the mounting of the mailbox unit 202 may be achieved in any other ways.

More specifically, where the top face of the main body 4 of the finisher 201 is closed by a top panel fixed thereto with screws, for example, the panel may be removed so as to allow for the mounting of the mailbox unit 202. In most cases, however, the main body 4 has an openable portion at its top for facilitating maintenance work of the periphery of the sheet inlet. Accordingly, the mailbox unit may be mounted on the finisher 22 by removing the openable portion. FIG. 13 illustrates the construction of a mailbox unit 250 to be employed advantageously in such a case. More specifically, the mailbox unit 250 has a path switching claw 251 provided in a sheet transportation path between a sheet inlet 3 and a path switching claw 211 for guiding sheets into the mailbox unit 250. A unit body 252 of the mailbox unit 250 is fixedly mounted on the top of the main body 4 of the finisher 201.

While the present invention has thus been described in detail by way of the embodiments thereof, it should be understood that these embodiments are merely illustrative of the technical principles of the present invention but not limitative of the same. The spirit and scope of the present invention are to be limited only by the appended claims.

This application claims priority benefits under 35 USC Section 119 on the basis of Japanese Patent Applications No. 10-176082, No. 10-215292 and No. 10-273416 filed to the Japanese Patent Office on Jun. 23, 1998, on Jul. 30, 1998 and on Sep. 28, 1998, respectively, the disclosure thereof being incorporated herein by reference.

What is claimed is:

1. A sheet handling unit, comprising:

a unit body;

a processing station fixedly provided in the unit body and having a stapling mechanism for stapling a plurality of sheets;

a plurality of mail trays fixedly attached to the unit body for receiving sheets transported thereto from the processing station;

a bulk tray attached in a vertically movable manner to the unit body for receiving sheets transported thereto from the processing station; and a sheet delivering mechanism for delivering sheets transported thereto from the processing station switchably to any of the mail trays or to the bulk tray.

2. A sheet handling unit as set forth in claim 1, wherein the sheet delivering mechanism includes a mail-tray sheet transporting mechanism for transporting the sheets transported thereto from the processing station toward the mail trays, a first switching mechanism for delivering the sheets transported thereto from the processing station switchably to the mail-tray sheet transporting mechanism or to the bulk tray, and a second switching mechanism for delivering the sheets transported into the mail-tray sheet transporting mechanism selectively to any of the plural mail trays.

3. A sheet handling unit as set forth in claim 1, wherein the processing station further includes a lateral edge aligning mechanism for aligning lateral edges of sheets, and an offset mechanism for shifting the lateral edge aligning mechanism in a sheet widthwise direction with the lateral edges of the sheets being aligned thereby.

4. A sheet handling unit as set forth in claim 1, further comprising:

a special-sheet tray fixedly attached to the unit body for receiving a special sheet other than standard size sheets;

a special-sheet transporting mechanism for transporting a sheet introduced into the unit body not via the processing station but directly to the special-sheet tray; and a special sheet switching mechanism for delivering a sheet switchably to the processing station or to the special-sheet transporting mechanism.

5. A sheet handling unit as set forth in claim 4, wherein the special-sheet tray faces a sheet transportation path of the mail-tray sheet transporting mechanism, whereby the mail-tray sheet transporting mechanism can deliver the sheets transported thereto from the processing station to the special-sheet tray.

6. A sheet handling unit as set forth in claim 4, wherein the mail-tray sheet transporting mechanism includes an endless belt which extends along a first transportation path defined along alignment of proximal portions of the plural mail trays and is rotatable in normal and reverse directions, and a first roller which is adapted to hold a sheet between itself and a transport surface of the endless belt opposed to the first transportation path for sheet transportation, the endless belt extending along a second transportation path extending from the special sheet switching mechanism to the special-sheet tray, wherein the special-sheet transporting mechanism includes a second roller which is adapted to hold a sheet between itself and a transport surface of the endless belt opposed to the second transportation path for sheet transportation.

7. A sheet handling unit as set forth in claim 6, wherein the plurality of mail trays are arranged in a vertically spaced and tiered relation, and the special-sheet tray is a top tray disposed above the plurality of mail trays, wherein the endless belt is entrained around a pair of rollers vertically spaced from each other along arrangement of the plurality of mail trays and the top tray, wherein the surface portion of the endless belt opposed to the plurality of mail trays serves as a transport surface for sheet transportation to the mail trays, and the surface portion of the endless belt opposite from the mail trays serves as a transport surface for sheet transportation to the top tray, and wherein the lower one of the pair of rollers faces the special sheet switching mechanism.

8. A sheet handling system comprising:

a sheet post-processing unit including a main body, and a stationary processing station for performing a predetermined process on sheets, the stationary processing station including a stapling mechanism for stapling a plurality of sheets, and a sheet stacking section; and a sheet handling unit mountable to the sheet post-processing unit, the sheet handling unit including a unit body attachable to a top of the main body of the sheet post-processing unit, a plurality of sheet trays which are each capable of receiving sheets, an internal sheet transporting mechanism for delivering a sheet from the processing station selectively to any of the plural sheet trays, and a path switching mechanism for switching a transport path to guide a sheet introduced into the sheet post-processing unit to the internal sheet transporting mechanism.

9. A sheet handling system as set forth in claim 8, wherein the sheet stacking section includes a sheet receiver tray for receiving sheets discharged from a sheet outlet provided in an upper portion of the main body of the sheet post-processing unit, and, wherein the path switching mechanism faces the sheet outlet.

10. A sheet handling system as set forth in claim 8, wherein the sheet stacking section includes a sheet receiver tray for receiving sheets discharged from a sheet outlet provided in an upper portion of the main body of the sheet post-processing unit, and, wherein the path switching mechanism is located in a sheet transportation path extending between a sheet inlet of the sheet post-processing unit and the sheet outlet.

11. A sheet handling system as set forth in claim 8, wherein the sheet post-processing unit includes a switchable sheet delivering mechanism for delivering the sheet introduced into the sheet post-processing unit switchably to the sheet receiver tray or to the processing station, and wherein the path switching mechanism is located upstream of the switchable sheet delivering mechanism with respect to a sheet transportation direction in the sheet transportation path.

* * * * *